US006113000A

United States Patent [19]

Tian

[11] Patent Number: 6,113,000

[45] Date of Patent: Sep. 5, 2000

[54] HYDRAULICALLY-ACTUATED FUEL INJECTOR WITH INTENSIFIER PISTON ALWAYS EXPOSED TO HIGH PRESSURE ACTUATION FLUID INLET

[75] Inventor: Steven Y. Tian, Bloomington, Ill.

[73] Assignee: Caterpillar Inc., Peoria, Ill.

[21] Appl. No.: 09/141,742

[22] Filed: Aug. 27, 1998

[51] Int. Cl.[7] ..... F02M 47/02

[52] U.S. Cl. ..... 239/88; 239/533.8

[58] Field of Search ..... 239/88–92, 533.8

[56] References Cited

U.S. PATENT DOCUMENTS

| | | | |
|---|---|---|---|
| 4,378,774 | 4/1983 | Kato | 239/88 |
| 4,951,631 | 8/1990 | Eckert | 239/88 |
| 5,421,521 | 6/1995 | Gibson et al. | 239/585.4 |
| 5,423,484 | 6/1995 | Zuo | 239/90 |
| 5,429,309 | 7/1995 | Stockner | 239/533.8 |
| 5,460,329 | 10/1995 | Sturman . | |
| 5,487,508 | 1/1996 | Zuo | 239/533.5 |
| 5,505,384 | 4/1996 | Camplin | 239/533.5 |
| 5,538,187 | 7/1996 | Mueller et al. | 239/88 |
| 5,632,444 | 5/1997 | Camplin et al. | 239/88 |
| 5,641,121 | 6/1997 | Beck et al. | 239/92 |
| 5,645,224 | 7/1997 | Kock | 239/533.4 |
| 5,669,355 | 9/1997 | Gibson et al. | 123/446 |
| 5,682,858 | 11/1997 | Chen et al. | 123/467 |
| 5,687,693 | 11/1997 | Chen et al. | 123/446 |
| 5,697,342 | 12/1997 | Anderson et al. | 123/446 |
| 5,738,075 | 4/1998 | Chen et al. | 123/446 |

FOREIGN PATENT DOCUMENTS 0 828 073 7/1997 European Pat. Off. .

*Primary Examiner*—Steven O. Douglas
*Attorney, Agent, or Firm*—Michael B. McNeil

[57] ABSTRACT

A hydraulically-actuated fuel injector includes an injector body that defines an actuation fluid inlet that is open to a first actuation fluid cavity, and a second actuation fluid cavity that is connected to the first actuation fluid cavity via a connection passage. The injector body also defines at least one actuation fluid drain. A source of relatively high pressure actuation fluid is connected to the actuation fluid inlet. A relatively low pressure reservoir is connected to the at least one actuation fluid drain. A control valve is attached to the injector body and is moveable between a first position in which the second actuation fluid cavity is open to the first actuation fluid cavity, and a second position in which the second actuation fluid cavity is open to the at least one actuation fluid drain. An intensifier piston is movably mounted in the injector body and has a primary hydraulic surface exposed to fluid pressure in the first actuation fluid cavity, and an opposing hydraulic surface exposed to fluid pressure in the second actuation fluid cavity.

20 Claims, 1 Drawing Sheet

HYDRAULICALLY-ACTUATED FUEL INJECTOR WITH INTENSIFIER PISTON ALWAYS EXPOSED TO HIGH PRESSURE ACTUATION FLUID INLET

TECHNICAL FIELD

The present invention relates generally to hydraulically-actuated fuel injectors, and more particularly to hydraulically-actuated fuel injectors with intensifier pistons having primary and opposing hydraulic surfaces.

BACKGROUND ART

Current hydraulically-actuated fuel injectors typically include three main portions: a control portion, a hydraulic pressurizing portion, and a nozzle portion. The control portion typically includes a solenoid with an armature and one or more operably connected valve members. The hydraulic pressurizing portion typically includes an intensifier piston and plunger assembly movably mounted in a piston/plunger barrel. The nozzle assembly portion typically includes a spring biased needle valve member that opens and closes a nozzle outlet. Of these three portions, the control portion is typically the one that causes most technical problems, such as injector to injector variations, injector stability, seat cavitation power growth or loss, and noise. In order to resolve these problems, many special manufacturing techniques, such as coating, special heat treatment and other special machining processes have significantly increased the cost of hydraulically-actuated fuel injectors.

From a performance point of view, many hydraulically-actuated fuel injectors can not do a split injection using wave form control because the control valve cannot respond fast enough. In order to produce a split injection, some hydraulically-actuated fuel injectors spill an amount of fuel at the beginning of the injection event. However, this split injection through fuel spilling increases plunger stroke, which can cause some structural problems and can only be accomplished with an undesirable energy loss. In addition, the control valve poppet member lower seat flow restriction limits the pressure capability, and injection duration cannot typically be reduced by simply increasing actuation fluid rail pressure. Since the control valve's spring cavity works in an alternating mode from high pressure to low pressure, lower seat cavitation is sometimes observed in hydraulically-actuated fuel injectors operating at idle condition with a high rail pressure. Because the injector has to be charged with high pressure actuation fluid during each injection event, yet be released from the high pressure between each injection, the timing for the charge and release is controlled by the movement of a poppet control valve member. It has been observed that the valve member moves slower at high rail pressure, causing the injection rate to ramp up more slowly and decay slowly. Consequently, it is often difficult for many hydraulically-actuated fuel injectors to produce a square injection rate profile. This same slowing of the poppet control valve member is often the reason why it is very difficult to reduce injection duration for relatively small high speed fuel injectors because the injection event mainly occurs during the brief poppet motion from its lower seat, to the upper seat, and back to its lower seat. This poppet control valve member slowing can also be the source of a reduction in mean effective injection pressures for high speed fuel injectors, even when peak injection pressure is relatively high.

In an effort to address some of these problems, some hydraulically-actuated fuel injectors have incorporated direct control needle valves in their operation. A direct control needle valve includes a needle valve member with a closing hydraulic surface, which can be exposed to either low or high pressure. The direct control needle valve allows the nozzle outlet to be held closed while fuel pressure builds within the injector, permits some split injection capabilities and rate shaping. In addition, these injectors often have the ability to abruptly close the nozzle outlet, even in the presence of highly pressurized fuel at injection pressures. In order for these hydraulically-actuated direct control needle fuel injectors to be a viable alternative to their predecessors, they typically must have the ability to accomplish their additional tasks without including an additional electronic actuator. While the inclusion of a direct control needle valve has proven realistic, new complications must necessarily develop due to the inclusion of additional high speed moving parts within the injector and the highly dynamic nature of component movements and fluid pressures within the injector during each injection event. In any event, many of the performance concerns associated with charging and releasing high pressure on the top of the intensifier piston within a hydraulically-actuated fuel injector remain with or without the incorporation of a direct control needle valve.

The present invention is directed to overcoming these and other problems associated with hydraulically-actuated fuel injectors that charge and release high pressure on the top of an intensifier piston during each injection cycle.

DISCLOSURE OF THE INVENTION

A hydraulically-actuated fuel injector includes an injector body that defines an actuation fluid inlet open to at a first actuation fluid cavity, and a second actuation fluid cavity connected to the first actuation fluid cavity via a connection passage. The injector body also defines at least one actuation fluid drain that is connected to a relatively low pressure reservoir. The actuation fluid inlet is connected to a source of relatively high pressure actuation fluid. A control valve is attached to the injector body and moveable between a first position in which the second actuation fluid cavity is open to the first actuation fluid cavity, and a second position in which the second actuation fluid cavity is open to at least one actuation fluid drain. An intensifier piston is movably mounted in the injector body and has a primary hydraulic surface exposed to fluid pressure in the first actuation fluid cavity, and an opposing hydraulic surface exposed to fluid pressure in the second actuation fluid cavity.

BEST MODE FOR CARING OUT THE INVENTION

Figure 1:
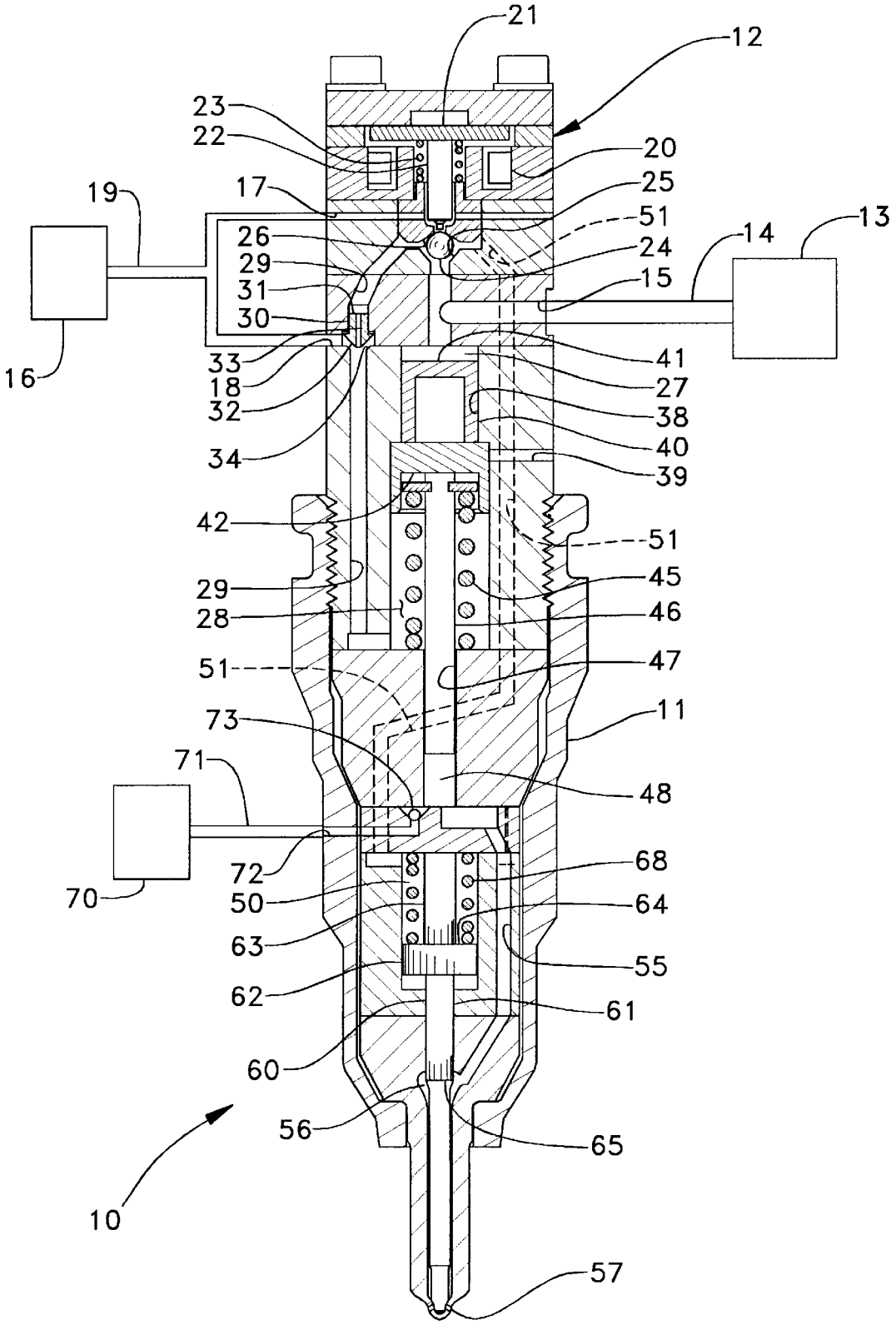
FIG. 1 is a sectioned side diagrammatic view of a fuel injector according to the present invention.

Referring now to FIG. 1, a hydraulically-actuated fuel injector 10 includes an injector body 11 made up of various components attached to one another in a manner well known in the art. Injector body 11 defines an actuation fluid inlet 15 that is connected to a source of relatively high pressure actuation fluid 13 via an actuation fluid supply passage 14. Injector body 11 also defines a first actuation fluid drain 17 and second actuation fluid drain 18 connected to a low pressure reservoir 16 via a common drain passage 19. Injector body 11 also defines a fuel inlet 72 connected to a source of medium pressure fuel fluid 70 via a fuel supply passage 71. Although the fuel fluid and actuation fluid could be the same type of fluid, such as diesel fuel, the actuation fluid is preferably a different fluid, such as engine lubricating oil.

Fuel injector 10 includes a control valve 12 attached to injector body 11 that includes a single two position solenoid 20, having an armature 21 attached to a pin 22. Control valve 12 also includes a ball valve member 24 that is trapped between a high pressure conically shaped valve seat 25 and a low pressure conically shaped valve seat 26. When solenoid 20 is de-energized, a compression spring 23 biases pin 22 to a position out of contact with ball 24 so that the high pressure entering at actuation fluid inlet 15 pushes ball valve member 24 upward to close low pressure seat 26. When solenoid 20 is energized, pin 22 moves downward to move ball valve member 24 to a position that closes high pressure seat 25.

Injector body 11 also defines a piston bore 38 within which an intensifier piston 40 reciprocates between a retracted position, as shown, and at a downward advanced position. Piston 40 includes a primary hydraulic surface 41 exposed to fluid pressure in a first actuation cavity 27, and an opposing hydraulic surface 42 exposed to fluid pressure in a second actuation fluid cavity 28. Primary hydraulic surface 41 is preferably about five to eight percent smaller than opposing hydraulic surface 42, such that if equal fluid pressures are acting on both hydraulic surfaces, piston 40 will tend to stay in its upward retracted position. Second actuation fluid cavity 28 is connected to the first actuation fluid cavity 27 via a connection passage 29. Although first actuation fluid cavity 27 is always open to the high pressure of actuation fluid inlet 15, second actuation fluid cavity 28 is only exposed to that high pressure when ball valve member 24 is in its upward position seated in low pressure seat 26. In addition to the different hydraulic surface areas, piston 40 is biased toward its retracted position by a return spring 45. Thus, when solenoid 20 is de-energized, both first actuation fluid cavity 27 and second actuation fluid cavity 28 are exposed to the high pressure of actuation fluid inlet 15, and piston 40 is biased toward its retracted position, due to spring 45 and the larger area of opposing hydraulic surface 42. Those skilled in the art will appreciate that return spring 45 could be eliminated and piston 40 would still retract between injection events due to the differing areas of the primary and opposing hydraulic surfaces 41, 42. The rate of piston return is controlled by the relative sizing of the hydraulic surface areas.

Because the flow areas past ball valve member 24 are relatively small, and because a relatively large volume of fluid must be displaced from second actuation fluid cavity 28 when piston 40 is undergoing its downward pumping stroke, injector body 11 preferably includes a relatively large diameter second actuation fluid drain 18 that is opened and closed by a pressure relief valve 30. Pressure relief valve 30 includes an upper hydraulic surface 31 separated from a lower hydraulic surface 32 by an internal passage 33, which connects the upper and lower portions of connection passage 29. Pressure relief valve 30 is moveable between an upward position in which second actuation fluid cavity 28 is open to actuation fluid drain 18, and a lower position seated in a seat 34 in which actuation fluid drain 18 is closed. Although not shown, pressure relief valve 30 might include a biasing means, such as a spring, to bias it downward to close seat 34. Although the presence of pressure relief valve 30 is desired, it is not necessary in those cases where an adequate flow area past ball valve member 24 can be maintained during an injection event.

The hydraulic means for pressurizing fuel includes a piston 46 movably mounted in a piston bore 47, and operably connected to move with intensifier piston 40. A portion of plunger bore 47 and plunger 46 define a fuel pressurization chamber 48 that is connected to fuel inlet 72 past a check valve 73. When plunger 46 is undergoing its upward return stroke between injection events, fresh fuel is drawn into a fuel pressurization chamber 48 past check valve 73. When plunger 46 is undergoing its downward pumping stroke during an injection event, check valve 73 closes. Fuel pressurization chamber 48 is also fluidly connected to a nozzle outlet 57 via a nozzle supply passage 55 and a nozzle chamber 56.

A needle valve member 60 is movably mounted in injector body 11 between an open position in which nozzle outlet 57 is open, and a downward closed position in which nozzle outlet 57 is blocked. Needle valve member 60 includes a needle portion 61, a piston portion 62, and a pin stop portion 63. Needle valve member 60 includes an opening hydraulic surface 65 exposed to fluid pressure in nozzle chamber 56 and a closing hydraulic surface 64 exposed to fluid pressure in a needle control chamber 50. Needle control chamber 50 is connected by a needle control passage 51 to the area between high pressure seat 25 and low pressure seat 26. Needle valve member 60 is mechanically biased toward its downward closed position by a biasing spring 68. In order for needle valve 60 to function as a direct control needle valve, closing hydraulic surface 64 is preferably sized such that needle valve member 60 remains in its downward closed position when needle control chamber 50 is connected to high pressure, even when fuel pressure acting on lifting hydraulic surface 65 is at a relatively high injection pressure. When needle control chamber 50 is open to low pressure, needle valve member 60 operates as a conventional spring biased check valve such that it will move to its upward open position when fuel pressure acting on lifting hydraulic surface 65 is above a valve opening pressure sufficient to overcome biasing spring 68.

Industrial Applicability

Because primary hydraulic surface 41 of intensifier piston 40 is always exposed to the high pressure of actuation fluid inlet 15, each injection event is controlled by changing the fluid pressure in second actuation fluid cavity 28 that acts on opposing hydraulic surface 42. Before each injection event begins, ball valve member 24 is biased upward by fluid pressure to close low pressure seat 26, pressure relief valve 30 is biased downward by fluid pressure to close seat 34, piston 40 and plunger 46 are in their respective retracted positions, and needle valve 60 is in its downward closed position. At this time, needle control chamber 50, second actuation fluid cavity 28 and first actuation fluid cavity 27 are all exposed to the high pressure fluid of actuation fluid inlet 15.

The injection event is initiated by energizing solenoid 20 to push ball valve member 24 downward to close high pressure seat 25 and open low pressure seat 26. When this occurs, second actuation fluid cavity 28 is suddenly connected to the low pressure of first actuation fluid drain 17 via connection passage 29, internal passage 33 and low pressure seat 26. Because the flow areas through internal passage 33 and past ball valve member 24 are relatively small, a pressure differential quickly develops across pressure relief valve 30 such that a relatively high pressure is acting on lower hydraulic surface 32 and a relatively low pressure is acting on upper hydraulic surface 31. This causes pressure relief valve 30 to quickly move upward to also open second actuation fluid cavity 28 to the larger flow area of second actuation fluid drain 18 past seat 34. As pressure drops in second actuation fluid cavity 28, piston 40 and plunger 46 begin their downward movement due to the ever present high pressure acting on primary hydraulic surface 41. When this occurs, fuel pressure in fuel pressurization chamber 48 quickly rises.

Eventually, fuel pressure acting on lifting hydraulic surface 65 of the needle valve member 60 exceeds the valve opening pressure, which causes needle valve member 60 to move upward to its open position to commence the spraying of fuel out of nozzle outlet 57. Each injection event is ended by de-energizing solenoid 20, which allows ball valve member 24 to move upward under the action of fluid pressure to close low pressure seat 26. This abruptly connects needle control chamber 50 to the high pressure of actuation fluid inlet 15. This high pressure acting on closing hydraulic surface 64 causes needle valve member 60 to move quickly down to its closed position to abruptly end the injection event.

Because fuel injector 10 includes a direct control needle valve, those skilled in the art will recognize that split injections can easily be accomplished by briefly energizing and de-energizing solenoid 20 at the beginning portion of an injection event. Other desirable front end rate shaping can be accomplished by controlling the rate at which fluid may be displaced from second actuation fluid cavity 28 at the beginning of an injection event. This could be accomplished in a number of ways such as adjusting the mass properties and movement rate of relief valve 30, the diameter of its internal passage, and/or flow rates past low pressure seat 26. The internal passage through pressure relief valve 30 and the flow past high pressure seat 25 adjacent ball valve 24 must be sufficiently large that an adequate flow rate can be maintained between injection events such that the piston 40 and plunger 46 can fully retract.

The present invention presents several advantages over the prior hydraulically-actuated fuel injectors that cycle through high and low pressure acting on the top surface of their intensifier pistons. For instance, in the present invention there can be no loss of pressure from the common rail to the actuation fluid cavity acting on the top of the piston since there is no control valve intervening. This is important since pressure loss generally significantly reduces efficiency and increases pumping losses. In addition, the high pressure working environment within the injector substantially prevents cavitation from occurring, where as dealing with cavitation has always been a somewhat reoccurring problem in prior fuel injectors. The present invention is also believed to improve injector to injector consistency since one of the key elements that produced inconsistencies in the past, namely a poppet or spool control valve member, is eliminated. The present invention is also desirable in that a relatively small solenoid can be used since it need only move a ball valve member between seats rather than move a relatively large valve member to open and close large flow areas.

The above description is intended for illustrative purposes only, and is not intended to limit the scope of the present invention in anyway. For instance, while the described embodiment teaches the use of two separate fluids, those skilled in the art will appreciate that with a minor modification, an embodiment could be made to utilize fuel as both the hydraulic and fuel fluid mediums. Thus, various modifications could be made to the disclosed embodiment without departing from the intended spirit and scope of the invention, which is defined in terms of the claims set forth below.

I claim:

1. A hydraulically actuated fuel injector including:

an injector body defining an actuation fluid inlet open to a first actuation fluid cavity, and a second actuation fluid cavity connected to said first actuation fluid cavity via a connection passage, and further defining at least one actuation fluid drain;

a source of relatively high pressure actuation fluid connected to said actuation fluid inlet;

a relatively low pressure reservoir connected to said at least one actuation fluid drain;

a control valve attached to said injector body and being movable between a first position in which said second actuation fluid cavity is open to said first actuation fluid cavity, and a second position in which said second actuation fluid cavity is open to said at least one actuation fluid drain; and an intensifier piston movably mounted in said injector body and having a primary hydraulic surface exposed to fluid pressure in said first actuation fluid cavity and an opposing hydraulic surface exposed to fluid pressure in said second actuation fluid cavity.

2. The hydraulically actuated fuel injector of claim 1 further including a direct control needle valve that includes said injector body defining a nozzle outlet and a needle valve member with a closing hydraulic surface movably positioned in said injector body.

3. The hydraulically actuated fuel injector of claim 1 wherein said injector body further defines a fuel inlet connected to a source of fuel fluid; and said source of relatively high pressure actuation fluid that is different from said source of fuel fluid.

4. The hydraulically actuated fuel injector of claim 1 further including a single solenoid attached to said injector body and being operably connected to said control valve.

5. The hydraulically actuated fuel injector of claim 1 wherein said control valve includes a ball valve member trapped between a high pressure seat and a low pressure seat.

6. The hydraulically actuated fuel injector of claim 1 further including a pressure relief valve positioned in said connection passage between said control valve and said second actuation fluid cavity.

7. The hydraulically actuated fuel injector of claim 1 wherein said injector body defines a needle control chamber that is open to said actuation fluid inlet when said control valve is in said first position, and open to said at least one actuation fluid drain when said control valve is in said second position.

8. The hydraulically actuated fuel injector of claim 1 wherein said primary hydraulic surface is smaller than said opposing hydraulic surface.

9. A hydraulically actuated fuel injector including:

an injector body defining an actuation fluid inlet open to a first actuation fluid cavity, and a second actuation fluid cavity connected to said first actuation fluid cavity via a connection passage, and further defining at least one actuation fluid drain and a fuel inlet;

a source of relatively high pressure actuation fluid connected to said actuation fluid inlet;

a relatively low pressure reservoir connected to said at least one actuation fluid drain;

a source of medium pressure fuel fluid connected to said fuel inlet;

a control valve attached to said injector body and being movable between a first position in which said second actuation fluid cavity is open to said first actuation fluid cavity, and a second position in which said second actuation fluid cavity is open to said at least one actuation fluid drain; and an intensifier piston movably mounted in said injector body and having a primary hydraulic surface exposed to fluid pressure in said first actuation fluid cavity and an opposing hydraulic surface exposed to fluid pressure in said second actuation fluid cavity.

10. The hydraulically actuated fuel injector of claim 9 wherein said actuation fluid is different from said fuel fluid.

11. The hydraulically actuated fuel injector of claim 10 further including a single solenoid attached to said injector body and being operably connected to said control valve.

12. The hydraulically actuated fuel injector of claim 11 wherein said control valve includes a ball valve member trapped between a high pressure seat and a low pressure seat.

13. The hydraulically actuated fuel injector of claim 12 further including a pressure relief valve positioned in said connection passage between said control valve and said second actuation fluid cavity.

14. The hydraulically actuated fuel injector of claim 13 wherein said injector body defines a needle control chamber that is open to said actuation fluid inlet when said control valve is in said first position, and open to said at least one actuation fluid drain when said control valve is in said second position.

15. A hydraulically actuated fuel injector including:

an injector body defining an actuation fluid inlet open to a first actuation fluid cavity, and a second actuation fluid cavity connected to said first actuation fluid cavity via a connection passage, and further defining at least one actuation fluid drain;

a source of relatively high pressure actuation fluid connected to said actuation fluid inlet;

a relatively low pressure reservoir connected to said at least one actuation fluid drain;

a control valve attached to said injector body and being movable between a first position in which said second actuation fluid cavity is open to said first actuation fluid cavity, and a second position in which said second actuation fluid cavity is open to said at least one actuation fluid drain;

a single solenoid attached to said injector body and being operably connected to said control valve;

an intensifier piston movably mounted in said injector body and having a primary hydraulic surface exposed to fluid pressure in said first actuation fluid cavity and an opposing hydraulic surface exposed to fluid pressure in said second actuation fluid cavity; and a direct control needle valve that includes said injector body defining a nozzle outlet and a needle valve member with a closing hydraulic surface movably positioned in said injector body.

16. The hydraulically actuated fuel injector of claim 15 wherein said injector body defines a needle control chamber that is open to said actuation fluid inlet when said control valve is in said first position, and open to said at least one actuation fluid drain when said control valve is in said second position; and said closing hydraulic surface being exposed to fluid pressure in said needle control chamber.

17. The hydraulically actuated fuel injector of claim 16 further including a pressure relief valve positioned in said connection passage between said control valve and said second actuation fluid cavity.

18. The hydraulically actuated fuel injector of claim 17 wherein said pressure relief valve includes a relief valve member with an upper hydraulic surface exposed to fluid pressure in said connection passage adjacent said control valve, and a lower hydraulic surface exposed to fluid pressure in said second actuation fluid cavity.

19. The hydraulically actuated fuel injector of claim 18 wherein said relief valve member defines a central passage.

20. The hydraulically actuated fuel injector of claim 19 wherein said injector body defines a fuel inlet connected to a source of fuel fluid that is different from said actuation fluid.

* * * * *

UNITED STATES PATENT AND TRADEMARK OFFICE

CERTIFICATE OF CORRECTION

PATENT NO. : 6,113,000
DATED : September 5, 2000
INVENTOR(S) : Steven Y. Tian

It is certified that error appears in the above-identified patent and that said Letters Patent is hereby corrected as shown below:

Please change the inventor's name from:
Steven Y. Tian to Ye Tian

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*